US009618293B1

(12) United States Patent
Moy et al.

(10) Patent No.: US 9,618,293 B1
(45) Date of Patent: Apr. 11, 2017

(54) MUNITIONS STORAGE CONTAINER WITH DISABLING DEVICE FOR SINGLE-USE WEAPON STORED THEREIN

(71) Applicants: Leon Moy, Montclair, NJ (US); Daniel Ruland, Waldwick, NJ (US); Edward Yang, Stanhope, NJ (US); Jacek Foltynski, Bayonne, NJ (US)

(72) Inventors: Leon Moy, Montclair, NJ (US); Daniel Ruland, Waldwick, NJ (US); Edward Yang, Stanhope, NJ (US); Jacek Foltynski, Bayonne, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 524 days.

(21) Appl. No.: 14/038,061

(22) Filed: Sep. 26, 2013

(51) Int. Cl.
*F41A 35/00* (2006.01)

(52) U.S. Cl.
CPC ..... *F41A 35/00* (2013.01)

(58) Field of Classification Search
CPC F41A 35/00; F41A 99/00; F41C 33/06; F41F 3/042; F41F 3/052; F41F 3/058; F41F 3/065; F41F 3/07; F41F 3/077; F42D 5/04; F42B 39/14; F42B 39/22; F42B 39/24; F42B 39/26; F42B 39/30
USPC ..... 206/3, 317; 89/1.8–1.82
See application file for complete search history.

(56) References Cited

U.S. PATENT DOCUMENTS

| | | | | | |
|---|---|---|---|---|---|
| 2,701,985 | A * | 2/1955 | Smith | F41A 19/69 | 89/1.812 |
| 2,830,497 | A * | 4/1958 | Smoot | F41F 3/052 | 89/1.806 |
| 3,205,778 | A * | 9/1965 | Bauer | F41F 3/052 | 89/1.1 |
| 3,268,107 | A * | 8/1966 | Sperling | B01J 19/002 | 220/212.5 |
| 3,364,817 | A * | 1/1968 | Barton | F41F 3/042 | 102/380 |
| 3,468,213 | A * | 9/1969 | Hersh | F41F 3/07 | 102/374 |
| 3,602,091 | A * | 8/1971 | Fryklund | F41F 3/052 | 89/1.806 |
| 4,572,463 | A * | 2/1986 | Ashkenazi | F42B 10/18 | 244/3.29 |
| 5,206,450 | A * | 4/1993 | Piesik | F41F 3/0413 | 89/1.8 |
| 5,291,820 | A * | 3/1994 | Hainsworth | F41F 3/052 | 89/1.806 |
| 5,959,193 | A * | 9/1999 | Rubitschung | A62C 4/02 | 49/31 |
| 2009/0007764 | A1* | 1/2009 | Gaigler | F41A 17/06 | 89/1.812 |

* cited by examiner

*Primary Examiner* — Stephen M Johnson
*Assistant Examiner* — Benjamin Gomberg
(74) *Attorney, Agent, or Firm* — Michael C. Sachs

(57) ABSTRACT

A munitions disabling device is disposed in a storage container proximate the muzzle of a single-use weapon. A projectile having a fused warhead is loaded in the weapon prior to storing the weapon. If an unplanned stimulus launches the projectile while the weapon is in the storage container, the projectile will impact or strike the disabling device. The disabling device prevents detonation or explosion of the warhead.

2 Claims, 6 Drawing Sheets

MUNITIONS STORAGE CONTAINER WITH DISABLING DEVICE FOR SINGLE-USE WEAPON STORED THEREIN

STATEMENT OF GOVERNMENT INTEREST

The inventions described herein may be manufactured, used and licensed by or for the United States Government.

BACKGROUND OF THE INVENTION

The invention relates in general to munitions, and in particular to compliance with Insensitive Munitions (IM) standards.

IM standards require that, to the extent practicable, munitions are safe when subjected to unplanned stimuli. Shoulder-launched single-use weapons are problematic because the weapon is packaged and stored with the projectile (and warhead) already loaded in the weapon. When exposed to unplanned external stimuli, single-use shoulder-launched munitions may fail IM requirements. For example, an unplanned stimulus may ignite the propellant in the single-use shoulder-launched weapon, thereby launching the projectile and activating the arming sequence of the warhead. If the warhead arms, it may detonate on impact (IM Type I detonation reaction). An IM Type V burning reaction is required to pass most IM requirements, but can be very difficult to achieve. Thus, an improvement from a Type I detonation to a Type IV deflagration reaction is desirable if it may be easily achieved.

Known munition cans or containers have several forms, including boxes and tubes. Some of these cans have IM features that: 1) provide for the venting of gases; 2) provide ballistic protection; or 3) provide insulation to delay the reaction time so other IM features may be utilized. Ballistic protection against fragment impact is often costly in terms of both packaging cost and logistical cost (weight, volume). Venting and insulation alone are often not sufficient, and additional IM features must be built into the weapon. The additional IM features may not be feasible due to cost and technical difficulty. While there are known methods to contain exploding ammunition, none of the known methods can contain a projectile with an exploding warhead after it is launched from a weapon.

A need exists for an apparatus and method for achieving at least a Type IV deflagration reaction when a projectile is launched from a weapon by unplanned stimuli. The solution must be relatively low in cost and have minimal logistical impact.

SUMMARY OF INVENTION

One aspect of the invention is an apparatus including a single-use weapon having a barrel, a muzzle, and a projectile with a fused warhead loaded in the weapon. The barrel defines a bore with a central longitudinal axis and a bore cross-sectional area. The apparatus includes a storage container of a size for storing no more than one of the single-use weapon. The storage container has a central longitudinal axis. The single-use weapon is disposed in the storage container with the central longitudinal axis of the bore of the weapon generally parallel to the central longitudinal axis of the storage container.

The storage container includes first and second closed ends joined by a closed body. A projectile disabling device is disposed inside the storage container proximate the first closed end and proximate the muzzle of the weapon such that the projectile strikes the disabling device when the projectile is launched from the weapon.

In one embodiment, the disabling device is a metal plate having a planar surface that is angled with respect to the central longitudinal axis of the bore and that faces the muzzle. In another embodiment, the disabling device is a curved pipe with a bore. The disabling device may also be a metal plate positioned parallel to the bore axis of the weapon such that the metal plate intersects a projection of the bore cross-sectional area along the bore axis. In a further embodiment, the disabling device is a metal spike positioned generally parallel to the bore axis and transversely offset from the bore axis.

The disabling device may be a pivoting frame. The pivoting frame includes a pair of parallel sides spaced apart a width greater than a width of the projectile, a striking panel that connects the pair of sides at one end of the pivoting frame, and a rear panel that connects the pair of sides at the other end of the pivoting frame.

Another aspect of the invention is a method of disabling a projectile launched from a single-use weapon. The projectile includes a fused warhead. The method includes launching the projectile from the single-use weapon while the single-use weapon is in a storage container. Then, the fused warhead is disabled using a disabling device disposed in the storage container proximate a muzzle of the single-use weapon. Disabling the warhead may produce a Type IV Insensitive Munitions reaction.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

Figure 1:
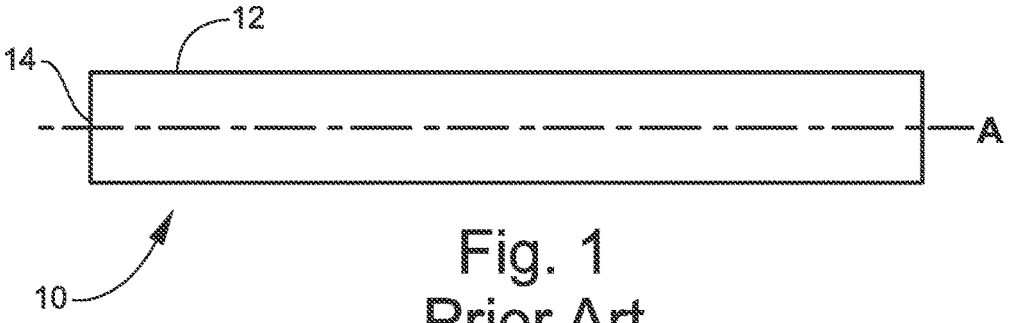
Fig. 1 Prior Art
FIG. 1 is a schematic drawing of one embodiment of a shoulder-launched single-use weapon.
Figure 2:
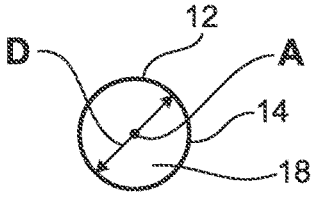
Fig. 2 Prior Art
FIG. 2 is a schematic drawing of the muzzle end of the weapon of FIG. 1.
Figure 3:
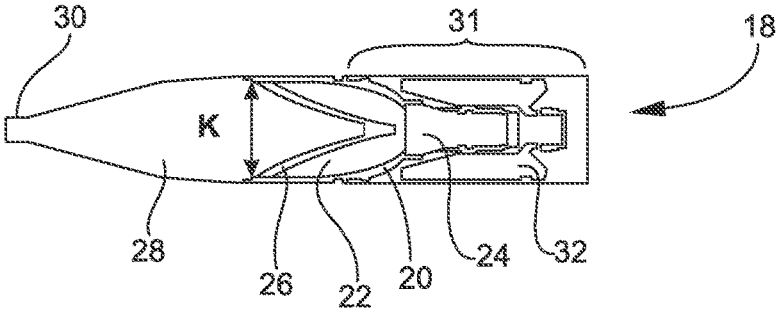
Fig. 3 Prior Art
FIG. 3 is a schematic cutaway drawing of one embodiment of a projectile for use in the weapon of FIG. 1.

FIG. 1 is a schematic view of one embodiment of a shoulder-launched single-use weapon 10 having a barrel or tube 12 with a muzzle end 14. Weapon 10 may be, for example, the U.S. Army M136 AT4 recoilless rifle. As seen in FIG. 2, barrel 12 has a bore 18 having a diameter or caliber D and a central longitudinal axis A. FIG. 3 is a schematic cutaway drawing of one embodiment of a projectile 18 that is loaded in tube 12 and launched by weapon 10.

Projectile 18 includes a warhead 20 containing an explosive composition 22. A fuze 24 is used to ignite or detonate explosive composition 22. Explosive composition 22 may fill only a portion of the interior of projectile 18 or substantially all of the interior of projectile 18. Warhead 20 may be, for example, in the form of a shaped charge with a liner 26 and a void or empty space 28 forward of liner 26. Fuse 24 may be located behind explosive composition 22. In some embodiments of projectile 18, fuse 24 may be located at the nose 30 of projectile 18 or at some other location. Projectile 18 may include a fin assembly 32 enclosed in a rear portion 31 of the external casing of projectile 18. Fuse 24 will not arm warhead 20 until sufficient time has elapsed for projectile 18 to travel a safe distance from weapon 10 and the weapon user. Prior to arming warhead 20, it is possible to disable warhead 20 and/or fuse 24.

Figure 4:
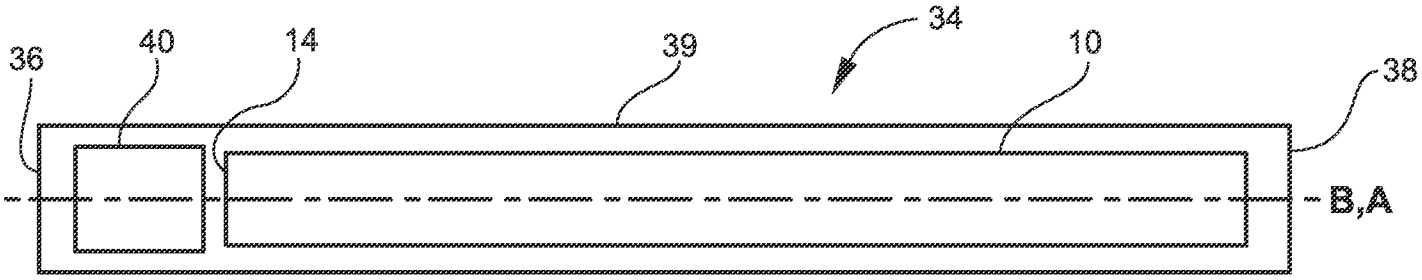
FIG. 4 is a schematic cutaway drawing of a storage container for a shoulder-launched single-use weapon.

Weapon 10 is stored in a storage container 34, shown schematically in FIG. 4. Projectile 18 with warhead 20 is loaded in weapon 10 prior to storage in container 34. Container 34 stores only a single weapon 10 and is sized for only a single weapon 10. Container 34 has a central longitudinal axis B. Weapon 10 is disposed in container 34 with bore axis A of weapon 10 generally parallel to axis B of container 34. Storage container 34 includes first and second closed ends 36, 38 joined by a closed body 39. Container 34 may be made of, for example, metal or wood. If wood is used, metal framing for container 34 may be required. The metal frame may be required to enable container 34 to maintain enough structural integrity during the fast cook-off test. Container 34 with loaded weapon 10 disposed therein is stored in a horizontal position, that is, bore axis A and container axis B are horizontal in the stored position. Multiple containers 34 with respective loaded weapons 10 therein may be stacked or palletized with axes A and B horizontal.

If an unplanned stimulus ignites the propellant (not shown in the Figures) in weapon 10, projectile 18 may be launched from weapon 10, even though weapon 10 is stored in container 34. The kinetic energy of the launched projectile 18 may be used to disable warhead 20 and/or fuse 24. A disabling device 40 may be stored in container 34 in front of muzzle 14 of weapon 10. When an unplanned launch of projectile 18 occurs, projectile 18 will impact or strike disabling device 40 in container 34. Disabling device 40 may be embodied in several forms.

Disabling device 40 may be a mass that damages projectile 18 or any of its components, for example, fuse 24 and/or warhead 20. The mass may simply cause damage by impact with projectile 18 thereby damaging fuse 24 and/or warhead 20. The mass may deflect or bend projectile 18 thereby deflecting, bending, shearing, or otherwise damaging fuze 24 or warhead 20. The mass may cut apart projectile 18 thereby damaging fuse 24 or warhead 20. The mass may puncture projectile 18, thereby damaging fuse 24 and/or warhead 20. The disabling device 40 may, in addition to other methods, use the force of impact to move, pivot or bend projectile 18 in a manner to damage fuse 24 located behind warhead 20, or to damage warhead 20, or to damage another fuse located behind a precursor warhead.

Figure 5:
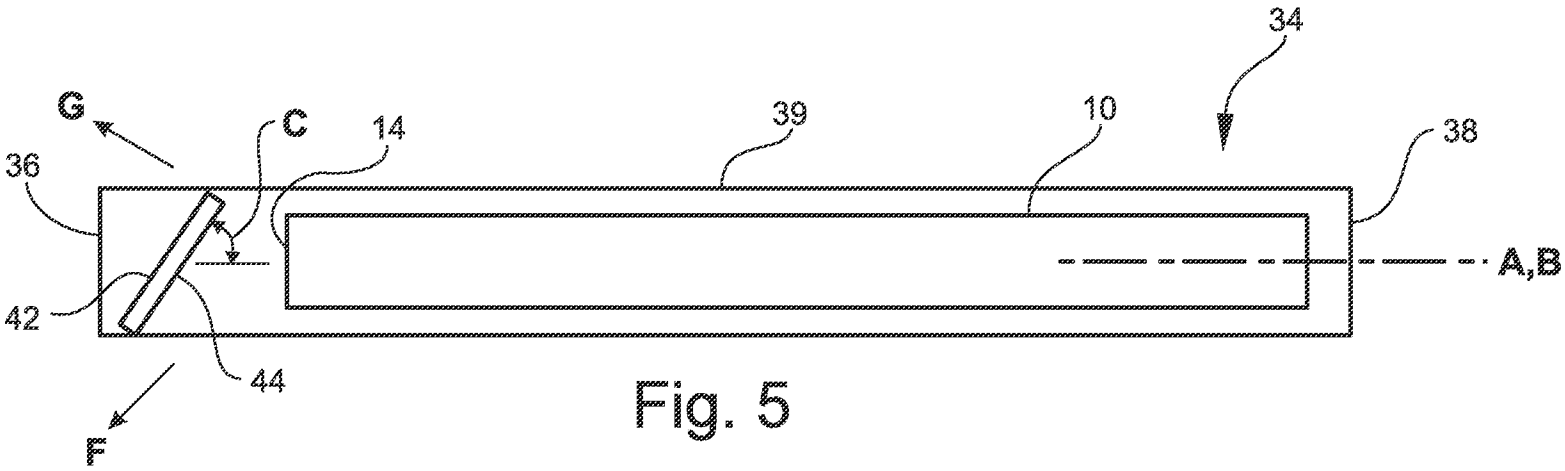
FIG. 5 is a schematic top view of one embodiment of a storage container having a disabling device in the form of a plate. The top portion of the container is cutaway.
Figure 6:
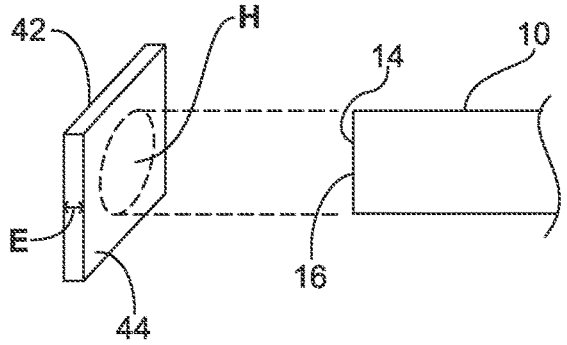
FIG. 6 is a schematic perspective view of the plate of FIG. 5 showing the projection of the bore cross-sectional area onto the plate.

FIG. 5 is a schematic top view of one embodiment of storage container 34 for shoulder-launched single-use weapon 10. The top portion of container 34 is cutaway. In FIG. 5, the disabling device is a metal plate 42 disposed inside container 34 proximate first closed end 36 and proximate muzzle 14 of weapon 10. FIG. 6 is a perspective view of plate 42. Plate 42 is placed such that projectile 18 will strike plate 42 when projectile 18 is launched from weapon 10.

Plate 42 may be made of metal, for example, low carbon steel. Plate 42 includes a planar surface 44 that forms an angle C (FIG. 5) with respect to axis A of bore 16 and that faces muzzle 14. Angle C may be, for example, in the range of 15 to 75 degrees, and, preferably, in the range of 40 to 50 degrees. Plate 42 may have a thickness E (FIG. 6) in the range of about ⅛ inch to about 1.5 inches. The area of planar surface 44 is at least as large as the area H of the projection of the cross-sectional area of bore 16 (FIG. 2) onto a plane parallel to planar surface 44.

As shown in FIG. 5, which is a view from above container 34, container 34 and weapon 10 are horizontal and plate 42 is preferably vertical. The preferred storage position is with container 34 and weapon 10 horizontal and with plate 42 vertical. In this position, components of deflected projectile 18 will travel in the general direction of arrow F and the deflected plate 42 will travel in the general direction of arrow G. Lateral deflection of projectile 18 and plate 42 is preferred rather than upward deflection of either projectile 18 or plate 42.

Plate 42 must be positioned in container 34 securely enough to prevent movement of plate 42 during routine shipping and handling of container 34. Of course, plate 42 will move after impact with projectile 18. Various methods may be used to position plate 42 in container 34. In one method, foam inserts may be disposed around plate 42 to maintain its position. If container 34 or a portion of container 34 is made of metal, another method of preventing unwanted movement of plate 42 is spot welding plate 42 at a few points to container 34 or its metal frame. There are numerous other methods to secure plate 42 in container 34 to prevent movement during routine shipping and handling.

Computer modeling and simulation tests were performed for a high energy projectile 18 fired from an M136 AT4 recoilless rifle and striking a one-half inch metal plate 42 at forty-five degrees. The simulation showed that the yield strength in the fuse and booster regions of projectile 18 was exceeded.

Actual tests were performed with a high energy projectile 18 striking low carbon steel plates with widths of ⅛, ¼, ⅜, ½, and one inch, respectively. When using either the one inch thick plate or the ½ inch thick plate: 1) fuse 24 separated from warhead 20; 2) the nose cone and half of shaped charge liner 26 shattered into 1 centimeter fragments; 3) shaped charge liner 26 was flattened; 4) explosive charge 22 pulverized into dust; and 5) fuse 24 did not arm. When using steel plates with ⅛, ¼, and ⅜ inch thicknesses, all plates successfully removed fuse 24 from warhead 20. The ¼ and ⅜ inch thick plates also opened the warhead 20. Damage to projectile 18 far exceeded expectations. The thickness of plate 42 needed to successfully de-arm projectile 18 was unexpectedly small.

Figure 7:
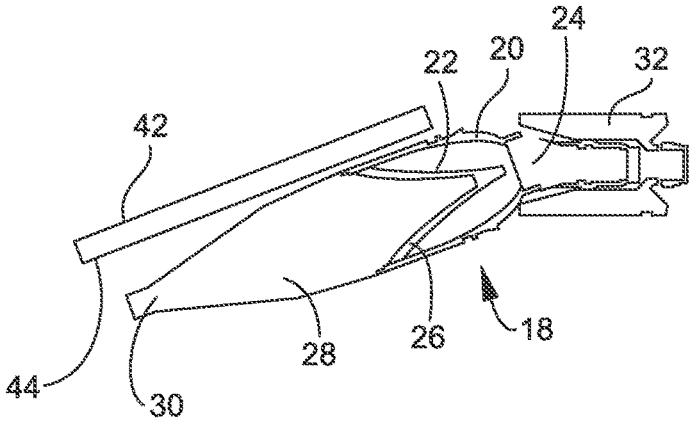
FIG. 7 is a schematic top view showing deflection of a projectile as it strikes a disabling plate.

FIG. 7 is a schematic top view showing deflection of projectile 18 as it strikes planar surface 44 of plate 42. The fuse 24 has broken away from warhead 20.

Figure 8:
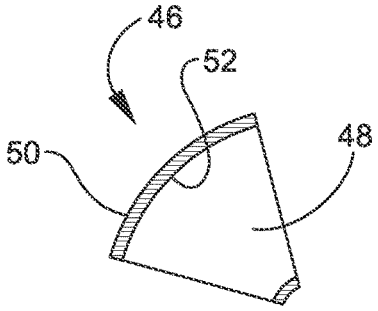
Fig. 8 Prior Art
FIG. 8 is a cutaway top view of a curved metal pipe or tube.
Figure 9:
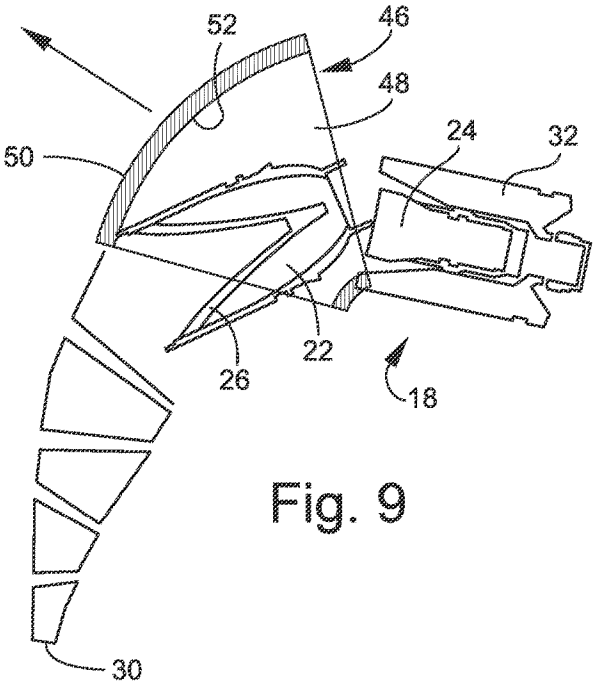
FIG. 9 is a schematic top view showing deflection of a projectile as it strikes a curved metal pipe.

FIG. 8 is a schematic cutaway top view of a curved metal pipe or tube 46 having a bore 48 and a wall 50 with an interior surface 52. Curved pipe 46 may be placed in container 34 in lieu of plate 42 such that projectile 18 strikes interior surface 52 of curved pipe 46 in a manner similar to that in which projectile 18 strikes plate 42. Curved pipe 46 may be secured in container 34 against movement during routine shipping and handling in a manner similar to plate 42. FIG. 9 is a schematic top view showing deflection of projectile 18 as it strikes interior surface 52 of curved metal pipe 46. The fuse 24 has broken away from warhead 20. Curved pipe 46 may be especially useful if projectile 18 has dual or tandem warheads. Both warheads will strike or be disabled by curved pipe 46.

Figure 10:
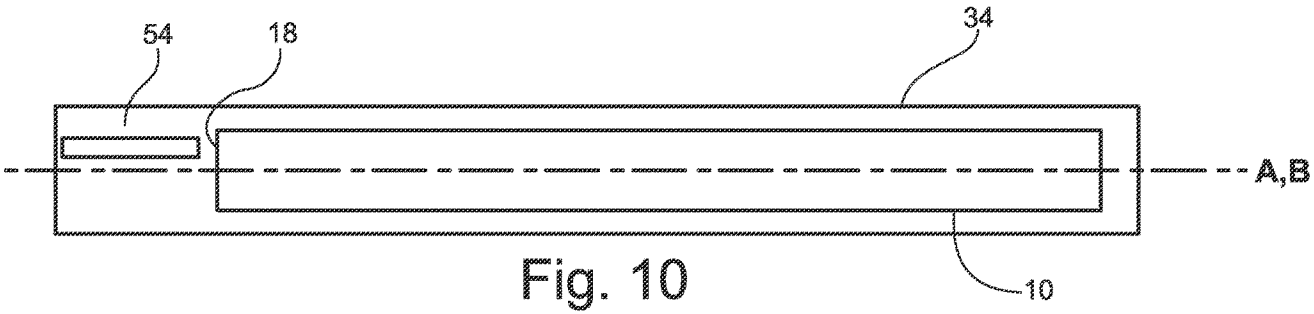
FIG. 10 is a schematic top view of another embodiment of a storage container having a disabling device in the form of a plate. The top portion of the container is cutaway.
Figure 11:
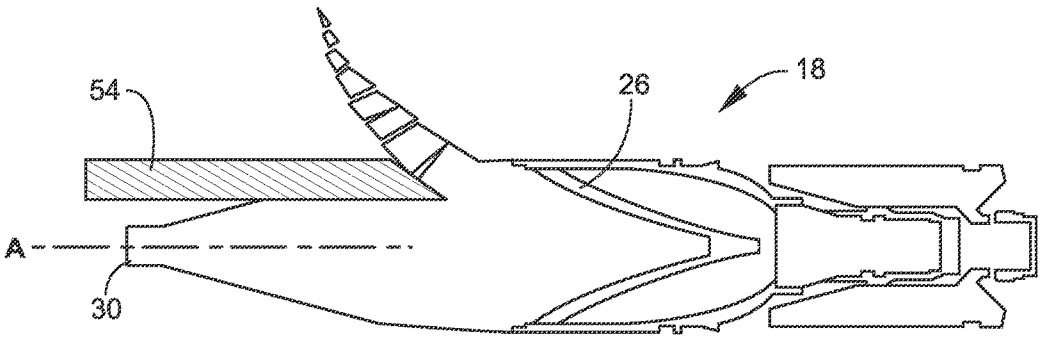
FIG. 11 is a schematic top view showing penetration of a projectile by the plate of FIG. 10.
Figure 12:
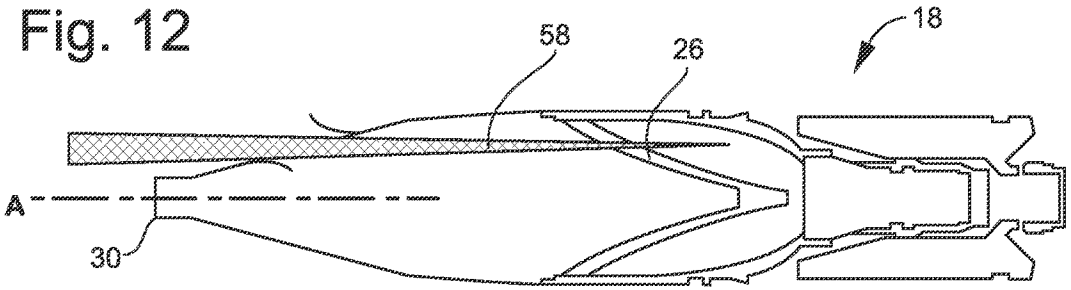
FIG. 12 is a schematic top view showing penetration of a projectile by a metal spike.

FIG. 10 is a schematic top view of another embodiment of a storage container 34 having a disabling device in the form of an axially-situated metal plate 54. The top portion of container 34 is cutaway. Metal plate 54 is positioned parallel to bore axis A such that metal plate 54 intersects a projection of the bore cross-sectional area along the bore axis A. As shown in FIG. 10, metal plate 54 is preferably offset transversely from bore axis A. FIG. 11 is a schematic top view showing penetration of projectile 18 by plate 54. FIG. 12 is a schematic top view showing penetration of projectile 18 by a metal spike 58. Spike 58 is positioned generally parallel to axis A and transversely offset from axis A.

Figure 13:
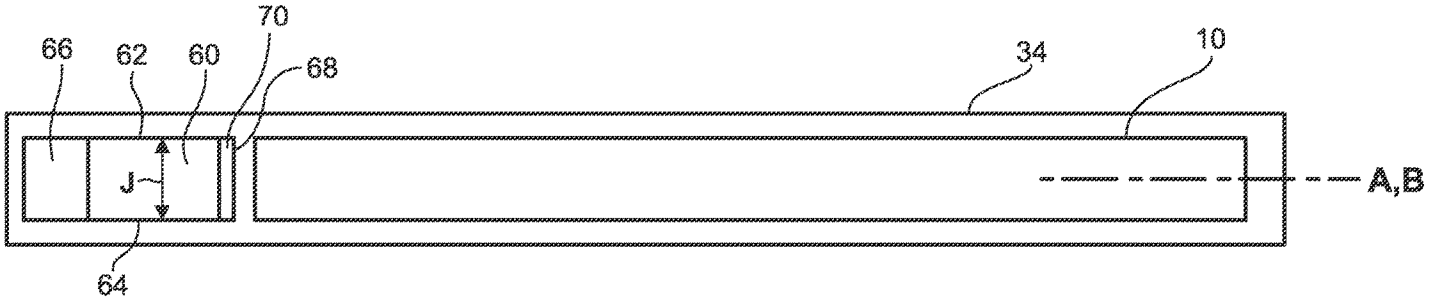
FIG. 13 is a schematic top view of another embodiment of a storage container having a disabling device in the form of a pivoting frame.
Figure 14:
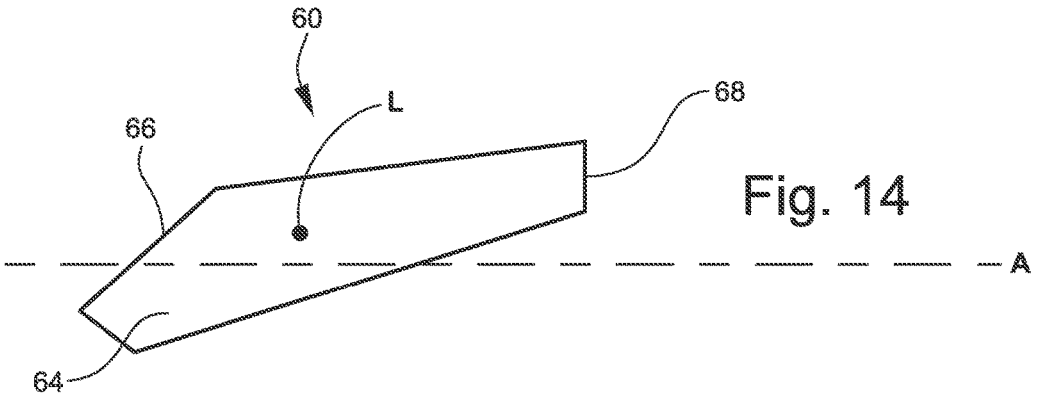
FIG. 14 is a side view of one embodiment of a pivoting frame.
Figure 15:
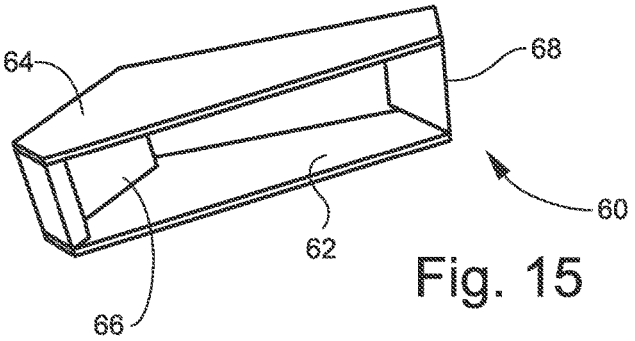
FIG. 15 is a bottom perspective view of the pivoting frame of FIG. 14.

FIG. 13 is a schematic top view of another embodiment of a storage container 34 having a disabling device in the form of a pivoting frame 60. FIG. 14 is a side view of pivoting frame 60 and FIG. 15 is a bottom perspective view of pivoting frame 60. Frame 60 may be made of metal, for example, steel. Frame 60 may include a pair of parallel sides 62, 64. Sides 62, 64 are spaced apart a width J (FIG. 13) that is greater than a width K (FIG. 3) of projectile 18. A striking panel 66 connects the pair of sides 62, 64 at one end of pivoting frame 60. A rear panel 68 connects the pair of sides 62, 64 at the other end of pivoting frame 60. In the embodiment shown in the Figures, rear panel 68 has the form of a wedge with the thickest portion 70 (FIG. 13) at the top of frame 60. A wedge shape may help rear panel 68 penetrate projectile 18.

In the storage position of container 34 shown in FIG. 13, axis A of bore 16 and axis B of container 34 are horizontal and the pair of parallel sides 62, 64 of pivoting frame 60 are in vertical planes. In this position, the center of gravity L (FIG. 14) of pivoting frame 60 is vertically above bore axis A. Pivoting frame 60 may be secured in container 34 against movement during routine shipping and handling in a manner similar to plate 42.

Figure 16:
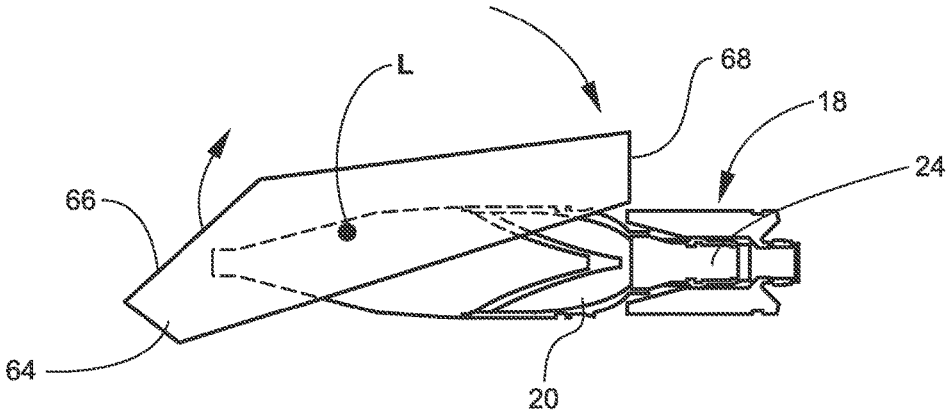
FIG. 16 is a schematic side view showing the impact of a projectile with the pivoting frame of FIG. 14.

FIG. 16 is a schematic side view showing projectile 18 impacting panel 66 of frame 60. The force of impact of projectile 18 on striking panel 66 causes frame 60 to rotate clockwise such that rear panel 68 plunges into projectile 18. Pivoting frame 60 may be especially useful if projectile 18 has dual or tandem warheads. Both warheads will strike or be disabled by pivoting frame 60.

While the invention has been described with reference to certain embodiments, numerous changes, alterations and modifications to the described embodiments are possible without departing from the spirit and scope of the invention as defined in the appended claims, and equivalents thereof.

What is claimed is:

1. In an apparatus comprising a single-use weapon having a barrel, a muzzle, and a projectile with a fused warhead loaded in the weapon, the barrel defining a bore with a central longitudinal axis and a bore cross-sectional area, and a steel storage container of a size for storing no more than one of said single-use weapon, the storage container having a central longitudinal axis, the single-use weapon being disposed in the storage container with the central longitudinal axis of the bore of the weapon generally parallel to the central longitudinal axis of the storage container, and the storage container including first and second closed ends joined by a closed body, and a projectile disabling device disposed inside the storage container proximate a first closed end thereof, and proximate the muzzle of the weapon such that the projectile strikes the disabling device when the projectile is launched from the weapon, and wherein the projectile disabling device comprises a pivoting frame having a pair of parallel sides spaced apart a width greater than a width of the projectile, a striking panel that connects the pair of sides at a forward end of the pivoting frame, and a rear panel that connects the pair of sides at the other end of the pivoting frame and having a solid wedge thereon, and wherein, in a storage position of the container with the axes of the bore of the weapon and the container in a horizontal plane and the pair of parallel sides of the pivoting frame in vertical planes, a center of gravity of the pivoting frame is vertically above the axis of the bore of the weapon, a method of disabling said projectile launched from said single-use weapon, comprising:

launching the projectile from the single-use weapon, while the single-use weapon is in the storage container, toward the striking panel; and then;

disabling the fused warhead using said projectile disabling device disposed in the storage container by striking the inside surface of the striking panel of the frame with the projectile, causing pivoting of the rear panel of the frame containing the wedge, thereby ramming the wedge into the projectile, and thereby producing a Type IV Insensitive Munitions reaction.

2. In an apparatus comprising a single-use weapon having a barrel, a muzzle, and a projectile with a fused warhead loaded in the weapon, the barrel defining a bore with a central longitudinal axis and a bore cross-sectional area, and a storage container of a size for storing no more than one of said single-use weapon, the storage container having a central longitudinal axis, and the single-use weapon being disposed in the storage container with the central longitudinal axis of the bore of the weapon generally parallel to the central longitudinal axis of the storage container, and the storage container including a disabling device disposed therein proximate the muzzle of the weapon, said disabling device being an open ended curved metal pipe with a bore, the curved pipe being positioned such that the projectile enters the open ended curved pipe bore and strikes an internal wall surface of the curved pipe when the projectile is launched from the weapon, a method of disabling said projectile launched from said single-use weapon, comprising:

launching the projectile from the single-use weapon while the single-use weapon is in the storage container, into the open ended curved pipe bore so that the projectile strikes the curved pipe, thereby disabling the fused warhead, and thereby also producing a Type IV Insensitive Munitions reaction.

* * * * *